US010885892B2

(12) United States Patent
Takasaki

(10) Patent No.: US 10,885,892 B2
(45) Date of Patent: Jan. 5, 2021

(54) SOUNDING CONTROL SYSTEM AND SOUNDING CONTROL METHOD

(71) Applicant: Roland Corporation, Shizuoka (JP)

(72) Inventor: Ryo Takasaki, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 16/632,378

(22) PCT Filed: Jul. 26, 2017

(86) PCT No.: PCT/JP2017/027135
§ 371 (c)(1),
(2) Date: Jan. 20, 2020

(87) PCT Pub. No.: WO2019/021405
PCT Pub. Date: Jan. 31, 2019

(65) Prior Publication Data
US 2020/0234683 A1 Jul. 23, 2020

(51) Int. Cl.
*G10D 13/02* (2020.01)
*G10H 1/02* (2006.01)
*G10H 3/14* (2006.01)

(52) U.S. Cl.
CPC ..... *G10H 1/02* (2013.01); *G10D 13/02* (2013.01); *G10H 3/143* (2013.01)

(58) Field of Classification Search
CPC ..... G10H 1/02; G10H 3/143; G10D 13/02
See application file for complete search history.

(56) References Cited

U.S. PATENT DOCUMENTS 7,741,551 B2 * 6/2010 Mori ..... G10D 13/28 84/421
8,648,243 B2 * 2/2014 Susami ..... G10H 1/0008 84/621
8,865,987 B2 * 10/2014 Mori ..... G10D 13/02 84/415
9,601,099 B2 * 3/2017 Steele ..... G10D 13/02
2012/0304848 A1 * 12/2012 Haddad ..... G10H 3/188 84/724

(Continued)

FOREIGN PATENT DOCUMENTS

JP 2005037922 2/2005
JP 2009145660 7/2009

(Continued)

OTHER PUBLICATIONS

"International Search Report (Form PCT/ISA/210) of PCT/JP2017/027135," dated Oct. 17, 2017, with English translation thereof, pp. 1-4.

*Primary Examiner* — Robert W Horn
(74) *Attorney, Agent, or Firm* — JCIPRNET

(57) ABSTRACT

The present invention provides a sounding control system capable of performing high-accuracy crosstalk suppression while reducing the processing load on a sound source device. When a first pad (12) vibrates, the first pad (12) generates sound emission data (62*a*1) that is information instructing a sound source device (11) to produce a sound and crosstalk cancellation determination data (62*a*2) that is information used for canceling crosstalk, and sends the data to the sound source device (11). The sound source device (11) determines whether or not crosstalk has occurred and controls sound emission using the information.

20 Claims, 7 Drawing Sheets

(56) References Cited

U.S. PATENT DOCUMENTS

| | | | | |
|---|---|---|---|---|
| 2013/0152768 | A1* | 6/2013 | Rapp | G10D 13/12<br>84/634 |
| 2013/0180386 | A1* | 7/2013 | Susami | G10H 1/0008<br>84/621 |
| 2020/0234683 | A1* | 7/2020 | Takasaki | G10D 13/02 |

FOREIGN PATENT DOCUMENTS

| | | |
|---|---|---|
| JP | 2013145262 | 7/2013 |
| JP | 2016122107 | 7/2016 |

* cited by examiner

| | Content | | | Size |
|---|---|---|---|---|
| 200 | Message ID | | | 1 byte |
| 201 | Trigger input ID | | | 1 byte |
| 62a1 | Sound emission data | 202 | Event type | 1 byte |
| | | 203 | Velocity MSB | 1 byte |
| | | 204 | Velocity LSB | 1 byte |
| | | 205 | Radial position | 1 byte |
| 62a2 | Crosstalk cancellation determination data | 206 | Trigger level MSB | 1 byte |
| | | 207 | Trigger level LSB | 1 byte |
| | | 208 | Crosstalk send level MSB | 1 byte |
| | | 209 | Crosstalk send level LSB | 1 byte |
| 210 | Reserve | | | 6 bytes |

FIG. 3

SOUNDING CONTROL SYSTEM AND SOUNDING CONTROL METHOD

CROSS-REFERENCE TO RELATED APPLICATION

This application is a 371 application of the International PCT application serial no. PCT/JP2017/027135, filed on Jul. 26, 2017. The entirety of the abovementioned patent application is hereby incorporated by reference herein and made a part of this specification.

TECHNICAL FIELD

The present invention relates to a sounding control system.

BACKGROUND ART

An electronic drum system in which a plurality of pads are installed on the same stand, and when the pads are struck by a user with a stick or the like and a sensor provided in the pads detects the striking, a sound source device is instructed to produce a musical sound corresponding to the struck surface of the pads is known. In the electronic drum system, when the user strikes one pad, the vibration may pass through the stand and cause crosstalk in another pad, and although the pad is not struck, a musical sound corresponding to the pad may be erroneously produced. In this case, since a sound that is not intended by the user is produced, the user feels discomfort. Therefore, in the electronic drum system, a process of preventing erroneous sound due to crosstalk (hereinafter referred to as a crosstalk cancellation process) is performed.

For example, in Patent Literature 1, a technology in which an analog signal indicating a vibration level output from a pad is converted into a digital signal with a high resolution in a sound source device and a crosstalk cancellation process is performed is disclosed. In this case, since the sound source device acquires a signal with a high resolution, it has an advantage of generating information for a crosstalk cancellation process with a high resolution.

On the other hand, in Patent Literature 2, a technology in which a crosstalk cancellation process is performed in a pad having a central processing unit (CPU) mounted therein is disclosed. The pad performs the crosstalk cancellation process by comparing vibration information detected by the pad itself with a strike strength included in sound instruction information output from other pads.

CITATION LIST

Patent Literature

[Patent Literature 1]
Japanese Patent Laid-Open No. 2013-145262
[Patent Literature 2]
Japanese Patent Laid-Open No. 2009-145660

SUMMARY OF INVENTION

Technical Problem

However, in Patent Literature 1, since the sound process is performed while generating information for a crosstalk cancellation process with a high resolution and performing the crosstalk cancellation process in the sound source device, there is a problem of a load on the sound source device increasing. On the other hand, in Patent Literature 2, in the sound source device, since there is no need to perform the crosstalk cancellation process together with the sound process, it is possible to reduce a load on the sound source device, but because strike strength information included in the sound instruction information output from other pads is used, there is a problem of the accuracy in the crosstalk cancellation process being lowered.

The present invention has been made in order to address the above problems, and an objective of the present invention is to provide a sounding control system that performs a crosstalk cancellation process more accurately while reducing a load on a sounding control device.

Solution to Problem

In order to achieve the above objective, a sounding control system of the present invention includes a plurality of struck surfaces configured to be struck by a user; at least one strike detection device that generates a sound instruction information based on a vibration that is generated by striking the struck surface; and a sounding control device configured to be connectable to the strike detection device and control, based on the sound instruction information generated by the strike detection device, a musical sound production corresponding to the generated sound instruction information, wherein the strike detection device includes a sound instruction information generation unit configured to generate the sound instruction information for instructing the sounding control device to produce a sound based on a vibration on the struck surface, a strike strength information generation unit configured to generate a strike strength information indicating a strike strength of the struck surface based on a vibration on the struck surface, a vibration strength information generation unit configured to generate a vibration strength information indicating a vibration strength of the struck surface when the struck surface is struck based on a vibration on the struck surface, and a transmission unit configured to transmit the sound instruction information generated by the sound instruction information generation unit to the sounding control device, and transmit the strike strength information generated by the strike strength information generation unit and the vibration strength information generated by the vibration strength information generation unit to the sounding control device together with a transmission of the sound instruction information, the sounding control device includes a determination unit configured to determine, based on a reception of the sound instruction information transmitted by the transmission unit, whether a vibration generated on a target struck surface which is a struck surface corresponding to the transmitted sound instruction information is caused by a crosstalk that should not be produced, which is generated based on a vibration on a comparison struck surface which is a struck surface other than the struck surface, a sounding control unit configured to, when it is determined by the determination unit that a vibration generated on the target struck surface is not caused by the crosstalk that should not be produced, execute a production of a sound for the vibration, and on the other hand, when it is determined that a vibration generated on the target struck surface is caused by the crosstalk that should not be produced, not execute a production of a sound for the vibration, and a vibration status information generation unit configured to generate a vibration status information that simulates a vibration status of a struck surface corresponding to the transmitted vibration strength information based on the vibration strength information transmitted by the transmission unit, wherein the determination unit includes a calculation unit configured to calculate a degree of the crosstalk received from the comparison struck surface based on the vibration status information that simulates the vibration status generated by the vibration status information generation unit for the comparison struck surface, and determines whether a vibration generated on the target struck surface is caused by the crosstalk that should not be produced based on a comparison between the degree of the crosstalk calculated by the calculation unit and the strike strength information transmitted by the transmission unit together with the sound instruction information.

Advantageous Effects of Invention

According to the sounding control system of the present invention, there are a plurality of struck surfaces that a user strikes. At least one strike detection device that generates sound instruction information based on a vibration generated by striking the struck surface can be connected to a sounding control device. In the sounding control device, based on the sound instruction information generated by the strike detection device, a musical sound production corresponding to the strike detection device that has detected the strike is controlled. In the strike detection device, sound instruction information for instructing the sounding control device to produce a sound based on the vibration on the struck surface is generated by the sound instruction information generation unit. In addition, in the strike detection device, strike strength information indicating the strike strength of the struck surface is generated by a strike strength information generating means based on the vibration on the struck surface, and vibration strength information indicating the vibration strength on the struck surface when the struck surface is struck is generated by the vibration strength information generation unit. Then, in the strike detection device, the sound instruction information generated by the sound instruction information generation unit is transmitted to the sounding control device together with the strike strength information generated by the strike strength information generation unit, and the vibration strength information generated by the vibration strength information generation unit. In the sounding control device, based on reception of the sound instruction information transmitted by the transmission unit of the strike detection device, the determination unit determines whether a vibration generated on the target struck surface which is a struck surface corresponding to the transmitted sound instruction information is caused by crosstalk that should not be produced, which is generated based on a vibration on a comparison struck surface which is a struck surface other than the struck surface. When it is determined that the vibration generated on the target struck surface is not caused by crosstalk that should not be produced, a sound is produced for the vibration by the sounding control unit. On the other hand, when it is determined that the vibration generated on the target struck surface is caused by crosstalk that should not be produced, production of a sound for the vibration is not executed by the sounding control unit. In addition, in the sounding control device, based on vibration strength information transmitted by the transmission unit, vibration status information that simulates the vibration status of the struck surface corresponding to the transmitted vibration strength information is generated by a vibration status information generating means. Thus, in the determination unit of the sounding control device, based on vibration status information that simulates the vibration status generated by the vibration status information generation unit for the comparison struck surface, a degree of crosstalk received from the comparison struck surface is calculated by the calculation unit, and based on comparison between the degree of crosstalk calculated by the calculation unit and strike strength information transmitted by the transmission unit together with the sound instruction information, it is determined whether the vibration generated on the target struck surface is caused by crosstalk that should not be produced. Therefore, the vibration strength information indicating the vibration strength of the struck surface which is information necessary for calculating the degree of crosstalk is generated by the strike detection device and transmitted to the sounding control device. Then, in the sounding control device, the degree of crosstalk is calculated based on the vibration strength information transmitted by the strike detection device. In addition, in the sounding control device, when the degree of crosstalk is calculated, the vibration strength information indicating the vibration strength of the strike detection device is used instead of the sound instruction information transmitted from the strike detection device. In addition, for determination of whether the vibration generated on the target struck surface is caused by crosstalk that should not be produced, the strike strength information indicating the strike strength of the struck surface generated by the strike detection device is used. Therefore, there is an effect that the crosstalk cancellation process can be performed more accurately while reducing a load on a sounding control device.

BRIEF DESCRIPTION OF DRAWINGS

FIG. 3 is a schematic view showing content of sound instruction information.

DESCRIPTION OF EMBODIMENTS

Figure 1:
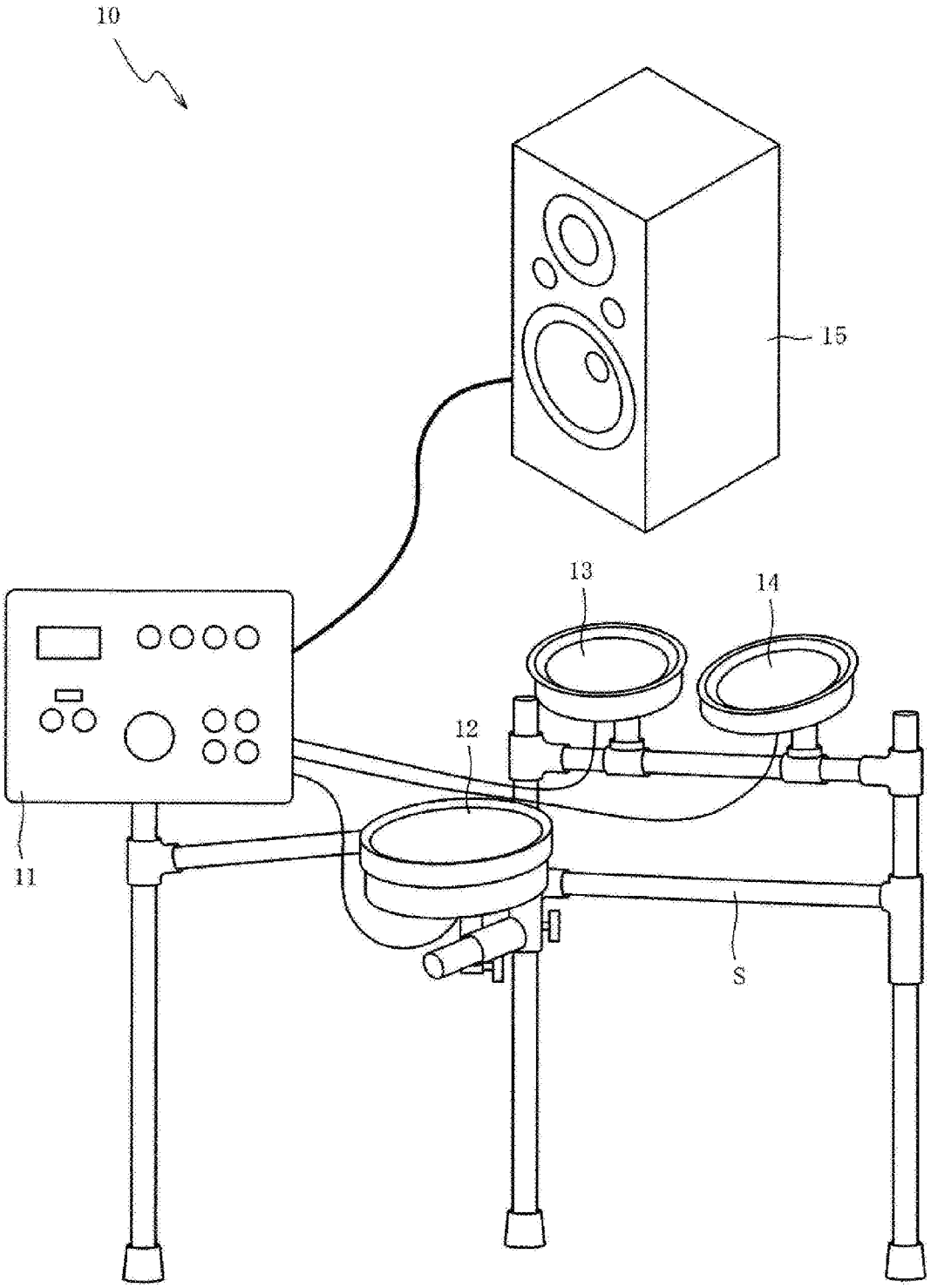
FIG. 1 is a diagram schematically showing an image of the whole electronic drum system according to an embodiment of the present invention.

Forms for implementing the present invention will be described below with reference to the appended drawings. First, an electronic drum system 10 according to an embodiment of the present invention will be described with reference to FIG. 1. FIG. 1 is a diagram schematically showing an image of the whole electronic drum system 10. The electronic drum system 10 includes a sound source device 11, a first pad 12, a second pad 13, a third pad 14, and a speaker 15. The first pad 12 to the third pad 14 and the speaker 15 are each connected to the sound source device 11. In the electronic drum system 10, when a user strikes the pads 12 to 14 to play an acoustic drum, sounds assigned to each of the pads are produced from the speaker 15 according to electronic processing by the sound source device 11.

The sound source device 11 is a device which includes sound source data and generates a signal of a sound produced from the speaker 15 according to sound instruction information received from the struck pad. The first pad 12 to the third pad 14 are pads having different types of tones to be produced such as the sound of a snare drum, a tom-tom drum, and the like. Here, the first pad 12 and the second pad 13 generate sound instruction information of a digital signal from a vibration of a strike and output it to the sound source device 11. The first pad 12 and the second pad 13 are connected to the sound source device 11 in a digital manner via a Universal Serial Bus (USB) cable. On the other hand, the third pad 14 outputs an analog signal indicating a vibration level of a strike to the sound source device 11 and is connected to the sound source device 11 in an analog manner. The speaker 15 is a device that produces a sound using a sound signal for a sound generated in the sound source device 11.

The first pad 12 to the third pad 14 are installed on the same stand S. Therefore, when one pad is struck, the vibration is transmitted to the other pads through the stand S and crosstalk occurs.

Figure 2:
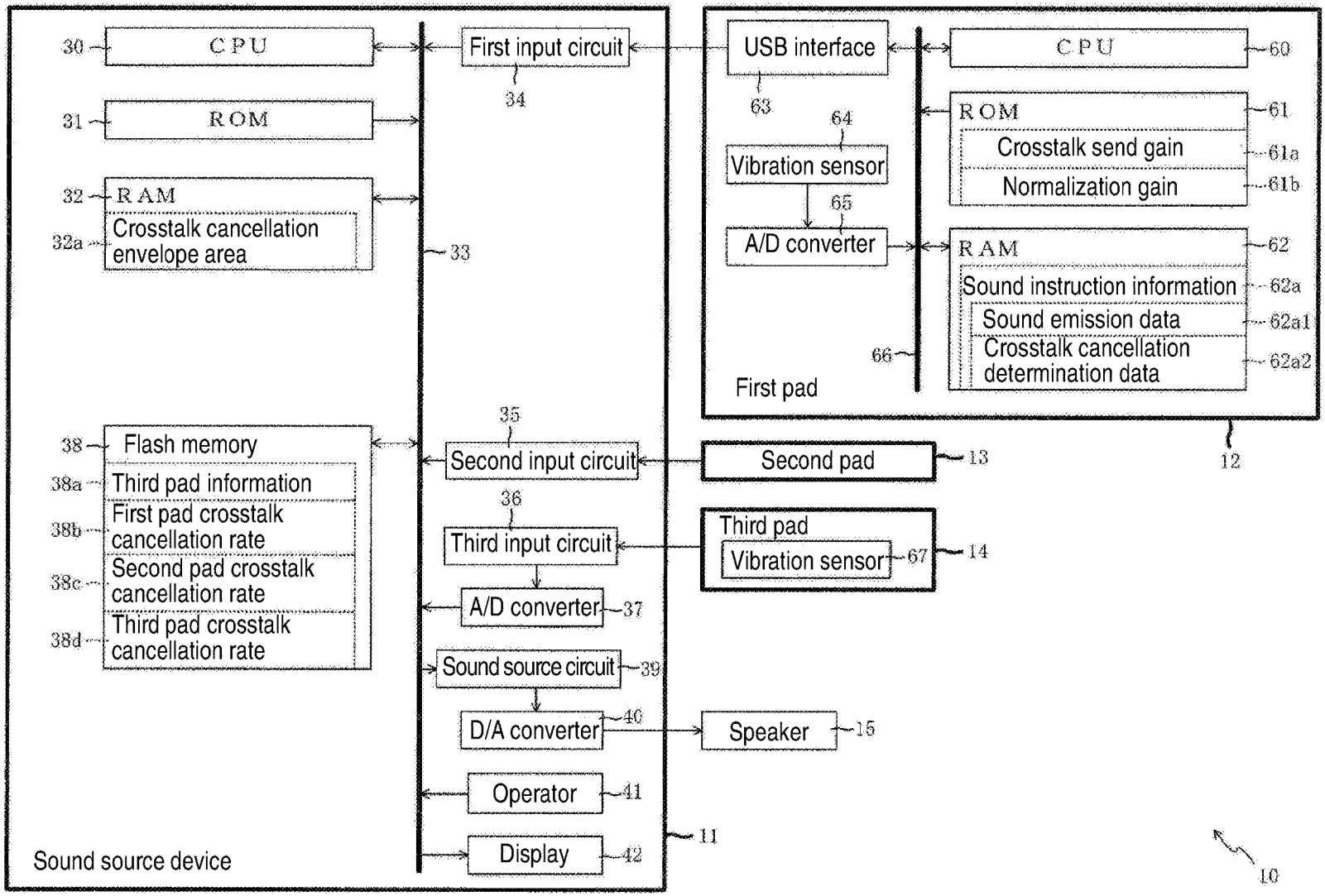
FIG. 2 is a block diagram showing an electrical configuration of a sound source device and pads.

Next, the electrical configuration of the first pad 12 to the third pad 14, and the sound source device 11 will be described with reference to FIG. 2. FIG. 2 is a block diagram showing an electrical configuration of the sound source device 11 and pads.

First, the first pad 12 will be described. Here, since the second pad 13 has the same configuration as the first pad 12, description thereof will be omitted here. The first pad 12 includes a CPU 60, a read only memory (ROM) 61, a random access memory (RAM) 62, a USB interface 63, a vibration sensor 64, and an A/D converter 65. The CPU 60, the output side of the ROM 61, the RAM 62, the input side of the USB interface 63, and the output side of the A/D converter 65 are connected to one another via a bus line 66. The USB interface 63 is connected to a first input circuit 34 of the sound source device 11 via a USB cable. The input side of the A/D converter 65 is connected to the vibration sensor 64.

The CPU 60 is a device that performs various controls and computations based on programs and fixed value data stored in the ROM 61, information stored in the RAM 62, and the like. The ROM 61 is a non-rewritable non-volatile memory for storing programs executed in the CPU 60 and fixed value data. The ROM 61 stores, as fixed value data, for example, a crosstalk send gain 61*a* and a normalization gain 61*b* that represent pad-specific characteristics that differ depending on the structure of the pad in a snare drum, a tom-tom drum, and the like. The crosstalk send gain 61*a* is a coefficient indicating ease of transmission of a vibration from the pad to the stand S and varies depending on the structure of the pad or a striking position on the pad. In addition, the normalization gain 61*b* is a coefficient for normalizing a difference in absolute outputs of the vibration sensor due to the difference of the structure of the pad. The crosstalk send gain 61*a* and the normalization gain 61*b* are used to calculate a crosstalk send level in an information generation process to be described with reference to FIG. 5. In addition, the normalization gain 61*b* is also used when a trigger level is calculated in the information generation process.

The RAM 62 is a rewritable volatile memory for temporarily storing information used in computation performed in the CPU 60 and computation result information. The RAM 62 stores, for example, sound instruction information 62*a* to be described below with reference to FIG. 3. The sound instruction information 62*a* is generated in the information generation process to be described below with reference to FIG. 5 and transmitted from the first pad 12 to the sound source device 11. The sound instruction information 62*a* is information for instructing the sound source device 11 to produce a sound and notifying the sound source device 11 of information necessary for a crosstalk cancellation process to be described below with reference to FIG. 6.

Here, the sound instruction information 62*a* will be described using the first pad 12 as an example with reference to FIG. 3. Since sound instruction information generated in the second pad 13 has the same content, description thereof will be omitted here. FIG. 3 is a schematic view showing content of the sound instruction information 62*a*. In the present embodiment, the sound instruction information 62*a* is transmitted from the first pad 12 to the sound source device 11 as one packet including 16-byte data. The sound instruction information 62*a* includes information about a message ID 200, a trigger input ID 201, sound emission data 62*al*, and crosstalk cancellation determination data 62*a*2. The remaining area of the sound instruction information 62*a* is a reserve 210.

The message ID 200 is information for indicating that information included in the packet is the sound instruction information 62*a* and is 1-byte information. The trigger input ID 201 is information for indicating a pad for outputting the sound instruction information 62*a* and is 1-byte information.

The sound emission data 62*al* is information for instructing, by the first pad 12, the sound source device 11 to produce a sound, based on the vibration of the first pad 12. The sound emission data 62*al* is generated in the CPU 60 based on vibration information output from the vibration sensor 64. The sound emission data 62*al* includes an event type 202, a velocity most significant byte (MSB) 203, a velocity least significant byte (LSB) 204, and a radial position 205, and is information of a total of 4 bytes. The event type 202 is information for indicating whether, when a user strikes the first pad 12, the strike is a head strike in which a struck surface (head) part of the pad is struck or a rim strike in which an edge (rim) part of the pad is struck and is 1-byte information. The velocity is information indicating the strength of a strike that reflects a sensitivity adjustment parameter that can be arbitrarily adjusted by the user, and the velocity MSB 203 indicates the most significant byte and is 1-byte information. The velocity LSB 204 indicates the least significant byte of the velocity and is 1-byte information. The radial position 205 indicates a distance from a position struck by the user to the center of the pad, is information for determining a tone based on the striking position, and is 1-byte information.

Figure 6:
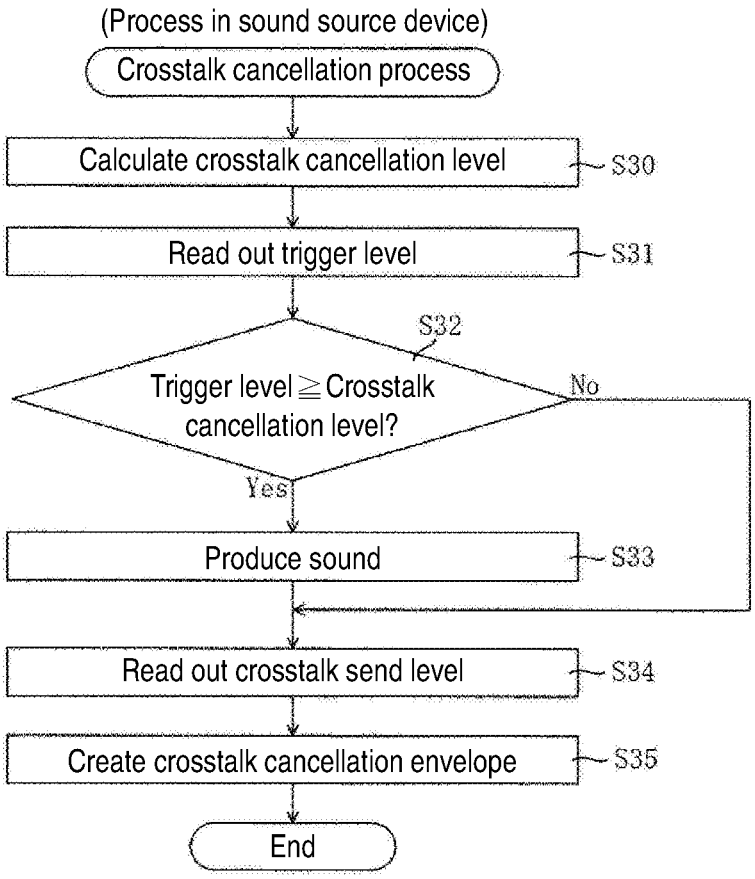
FIG. 6 is a flowchart of a crosstalk cancellation process performed in a sound source device.

The crosstalk cancellation determination data 62*a*2 is information generated in the CPU 60 based on vibration information output from the vibration sensor 64 and is information for the crosstalk cancellation process to be described below with reference to FIG. 6. The crosstalk cancellation determination data 62*a*2 includes a trigger level MSB 206, a trigger level LSB 207, a crosstalk send level MSB 208, and a crosstalk send level LSB 209.

The trigger level MSB 206 indicates the most significant byte of the trigger level and is 1-byte information. The trigger level LSB 207 indicates the least significant byte of the trigger level and is 1-byte information. The trigger level MSB 206 and the trigger level LSB 207 are information for indicating the trigger level of the first pad 12. The trigger level indicates the strike strength of the pad. Here, the output level of the vibration sensor 64 that indicates the volume of a sound desired to be produced for one vibration and does not reflect the sensitivity adjustment parameter that can be arbitrarily adjusted by the user is used as the strike strength of the pad. Specifically, the trigger level (TL) is obtained by the following Formula (1) using the sensor level (SL) and the normalization gain (NG).

$$TL=SL\times NG \quad (1)$$

Thereby, since the strike strength for the pad can be calculated by eliminating the influence of the difference in absolute outputs of the vibration sensor due to the structure of each pad, there is an effect that it is possible to more accurately determine whether the vibration generated in the pad is caused by crosstalk that should not be produced. In addition, the trigger level is obtained as 16-bit high-resolution information. Since the high resolution information is used to perform the crosstalk cancellation process, the crosstalk cancellation process can be performed more accurately.

The crosstalk send level MSB 208 indicates the most significant byte of the crosstalk send level and is 1-byte information. The crosstalk send level LSB 209 indicates the least significant byte of the crosstalk send level and is 1-byte information. These pieces of information are information for indicating the crosstalk send level of the first pad 12. The crosstalk send level is information for indicating, when a vibration is detected in the pad, the level of the vibration.

Here, the crosstalk send level (CSL) is obtained by multiplying the sensor level (SL) indicating a peak of a vibration in vibration information output from the vibration sensor 64 of the first pad 12 by the crosstalk send gain 61*a* (CSG) and the normalization gain 61*b* (NG). That is, the crosstalk send level (CSL) is obtained according to the following Formula (2). Here, the crosstalk send gain 61*a* is a coefficient indicating ease of transmission of a vibration from the pad to the stand S and varies depending on the structure of the pad or a striking position on the pad.

$$CSL=SL\times CSG\times NG \quad (2)$$

Here, the crosstalk send gain 61*a* is set according to the striking position on the pad determined by the output of the vibration sensor 64. The crosstalk send level obtained by Formula (2) is used to generate a crosstalk cancellation envelope to be described below, which is a virtual envelope that simulates the vibration status of the pad generated to calculate the degree of crosstalk. With the crosstalk send level, the vibration strength for the pad when the struck surface is struck can be calculated by eliminating the influence of the difference in absolute outputs of the vibration sensor due to the structure of each pad in consideration of ease of transmission of a vibration from the pad to the stand S, and thus the crosstalk cancellation envelope can approach the actual vibration status. Therefore, it is possible to more accurately determine whether the vibration generated in the pad is caused by crosstalk that should not be produced. The crosstalk send level is obtained as 16-bit high-resolution information. Since the high resolution information is used to perform the crosstalk cancellation process, the crosstalk cancellation process can be performed more accurately.

In the present embodiment, the reserve 210 has a space of 6 bytes.

The description will return to FIG. 2, and description of the first pad 12 will continue. The USB interface 63 is an interface that controls communication with other devices according to the USB standards. When the USB interface 63 is connected to the first input circuit 34 of the sound source device 11 in a digital manner, the digital signal sound instruction information 62*a* can be transmitted to the sound source device 11. The vibration sensor 64 is a device that detects a vibration on the struck surface of the first pad 12 and outputs an analog signal indicating the vibration level. The A/D converter 65 is a device that converts the analog signal indicating a vibration level output from the vibration sensor 64 into a digital signal. Therefore, the CPU 60 can use information related to the vibration.

Next, the third pad 14 will be described. The third pad 14 includes a vibration sensor 67. The vibration sensor 67 is a device that detects a vibration on the struck surface of the third pad 14 and outputs the vibration level information to the sound source device 11. The vibration sensor 67 is connected to a third input circuit 36 of the sound source device 11, and thus can output the vibration level information to the sound source device 11. Here, since the third pad 14 does not have a CPU, it is not possible to generate sound emission data and crosstalk cancellation determination data in the pad like the first pad 12. However, when the vibration level information is transmitted to the sound source device 11, it is possible to generate sound emission data and crosstalk cancellation determination data in the sound source device 11.

Next, the sound source device 11 will be described. The sound source device 11 includes a CPU 30, a ROM 31, a RAM 32, a bus line 33, the first input circuit 34, a second input circuit 35, the third input circuit 36, an A/D converter 37, a flash memory 38, a sound source circuit 39, a D/A converter 40, an operator 41, and a display 42. The CPU 30, the output side of the ROM 31, the RAM 32, the output side of the first input circuit 34, the output side of the second input circuit 35, the output side of the A/D converter 37, the flash memory 38, the output side of the operator 41, and the input side of the display 42 are connected to one another via the bus line 33. In addition, the sound source circuit 39 is connected to the input side of the D/A converter 40 and the speaker 15 is connected to the output side of the D/A converter 40.

The CPU 30 is a device that performs various controls and computations based on programs and fixed value data stored in the ROM 31, information stored in the RAM 32, and the like. The ROM 31 is a non-rewritable non-volatile memory for storing programs executed in the CPU 30 and fixed value data.

The RAM 32 is a rewritable volatile memory for temporarily storing various types of data and the like when various controls and computations are executed in the CPU 30. For example, a crosstalk cancellation envelope area 32*a* is provided in the RAM 32. The crosstalk cancellation envelope area 32*a* is an area in which a crosstalk cancellation envelope is stored. The crosstalk cancellation envelope is a virtual envelope that simulates the vibration status of the pad which outputs a vibration signal, and when sound instruction information is received from the first pad 12 and the second pad 13, the CPU 30 generates a crosstalk cancellation envelope that simulates the vibration status of the pad and stores it in the crosstalk cancellation envelope area 32*a* in association with the identification ID of the pad. In addition, when vibration level information is received from the third pad 14, the CPU 30 performs an analog connection sound process to be described with reference to FIG. 7 based on the vibration level information and thus generates crosstalk cancellation determination data, and generates a crosstalk cancellation envelope using the crosstalk cancellation determination data. Then, the envelope is stored in the crosstalk cancellation envelope area 32*a* in association with the identification ID of the third pad 14. The crosstalk cancellation envelope is used in the crosstalk cancellation process. The generation of a crosstalk cancellation envelope will be described below with reference to FIG. 6. The crosstalk cancellation envelope is stored in the RAM 32 for each vibration from when a vibration is generated by a strike until the vibration converges.

Figure 4:
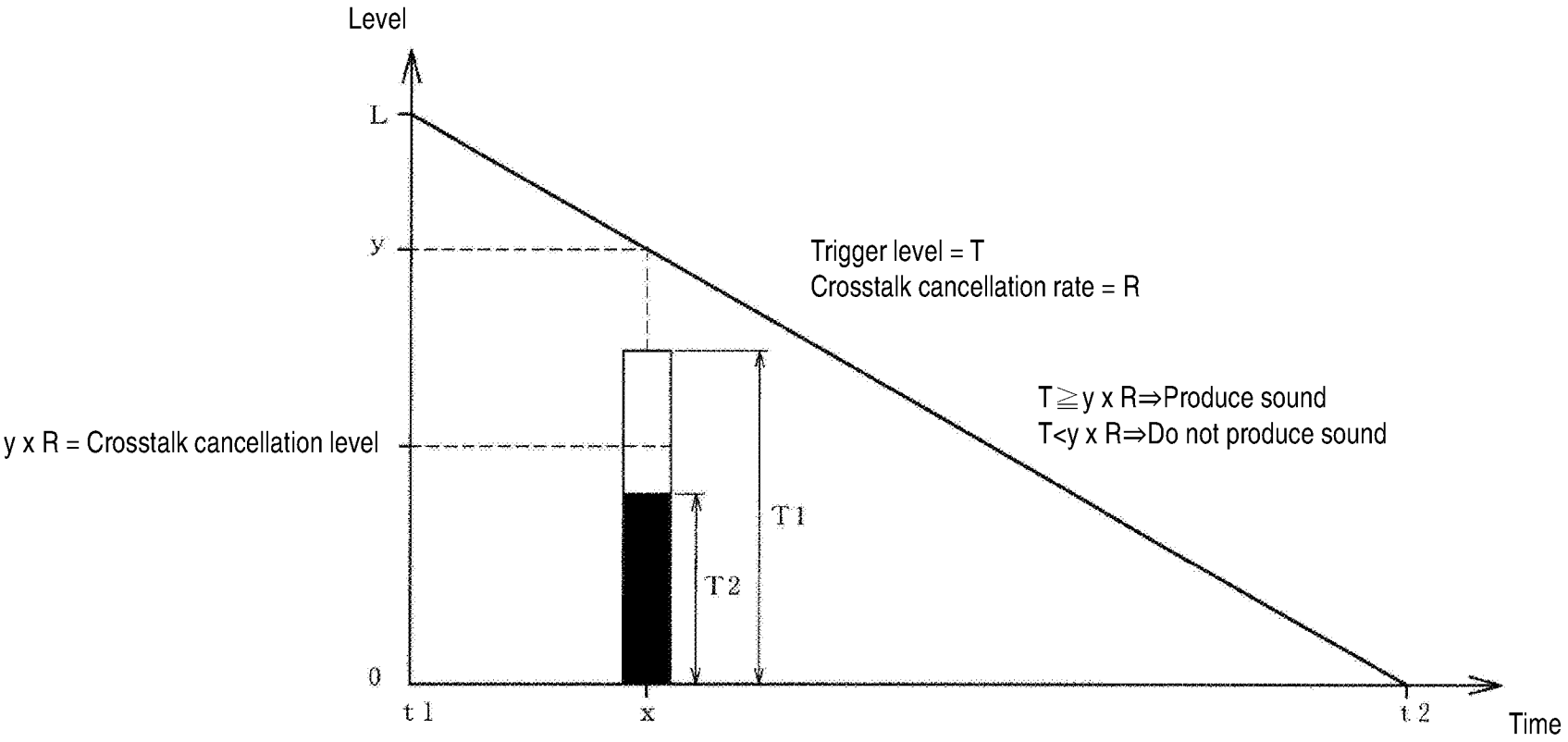
FIG. 4 is a schematic view of a crosstalk cancellation envelope for crosstalk cancellation processing.

Here, the crosstalk cancellation envelope will be described with reference to FIG. 4. Here, although a case in which a vibration detected by the second pad 13 is set as a determination target in the crosstalk cancellation process and a vibration on the first pad 12 generated therebefore is set as a comparison target will be exemplified, the same applies to the other pads, and thus description thereof will be omitted. FIG. 4 is a schematic view of a crosstalk cancellation envelope. The crosstalk cancellation envelope is an envelope for cancellation of crosstalk generated based on the vibration of the first pad 12. In this schematic view, the vertical axis represents the vibration level of the first pad 12 and the horizontal axis represents time. In addition, the time t1 is a time when the vibration of the first pad 12 has peaked, the time t2 is a time when the vibration has converged, and the time x is a time when sound instruction information of the second pad 13 as a crosstalk cancellation determination target is acquired by the sound source device 11. When crosstalk cancellation is determined for the third pad 14, the time when vibration level information of the third pad 14 is acquired by the sound source device 11 is the time x. The level L of the vibration represents a level of the vibration at the time t1 and the level y represents a level at the time x. T1 and T2 are trigger levels T at the time x for the second pad 13, that is, trigger levels included in sound instruction information transmitted from the second pad 13. In the crosstalk cancellation envelope, the level L at the time t1 is a crosstalk send level included in the sound instruction information 62*a* transmitted from the first pad 12. Then, the level decreases as time elapses and the level attenuates to 0 at the time t2. Here, the time from when the vibration has peaked until the vibration converges differs for each pad. That is, since ease of vibration varies depending on the structure of the pad in a tom-tom drum, a snare drum, and the like, even if the vibration level is the same, the time in which the vibration converges differs for each pad. Then, the time from when the vibration has peaked until the vibration converges is stored in advance in the flash memory 38 of the sound source device 11 to correspond to each pad and used when the envelope is generated.

The crosstalk cancellation envelope is generated as follows. That is, the horizontal axis represents time, the vertical axis represents the vibration level, and the time when sound instruction information is received from the first pad 12 or the second pad 13 or the time when vibration level information is received from the third pad 14 is set as a time t1 when the vibration has peaked. The vibration level at the time t1 is set to the crosstalk send level L included in the sound instruction information or the crosstalk send level L calculated from vibration level information. Then, with respect to the pad that generates the crosstalk cancellation envelope, the vibration level is linearly attenuated so that the vibration level is 0 until vibration stored in advance in the flash memory 38 converges.

In the crosstalk cancellation process, determination of whether a sound is produced based on the vibration received by the second pad 13 is performed by comparing a crosstalk cancellation level (CCL) obtained from the crosstalk cancellation envelope generated based on the vibration level of the first pad 12 and the third pad 14 with a trigger level (T) obtained from the vibration of the second pad 13. The crosstalk cancellation level indicates the degree of crosstalk and is information indicating, when a certain pad is struck and the vibration is transmitted to another pad that is a crosstalk cancellation determination target, a level of the vibration predicted to be received by the determination target pad. In the example in FIG. 4, the crosstalk cancellation level is information indicating, when the first pad 12 is struck and the vibration is transmitted to the second pad 13 that is a determination target, a level of the vibration predicted to be received by the second pad 13. On the other hand, the trigger level is information indicating the strike strength of the pad that is a determination target. In the example in FIG. 4, the trigger level is information indicating the strike strength when the second pad 13 is struck. The trigger levels T1 and T2 shown in FIG. 4 schematically illustrate the strike strength when the second pad 13 is struck.

If the trigger level is equal to or higher than the crosstalk cancellation level, it can be determined that the vibration of the second pad 13 is not caused by crosstalk of the vibration of the first pad 12 but is caused by the second pad 13 actually being struck. Therefore, a sound is produced based on sound instruction information corresponding to the vibration of the second pad 13. For example, like the trigger level T1 in FIG. 4, when T indicating the trigger level of the second pad 13 is equal to or higher than the crosstalk cancellation level (yxR), it is determined that the vibration of the first pad 12 is not caused by crosstalk, and a sound is produced based on the sound instruction information 62*a* corresponding to the vibration of the second pad 13. On the other hand, when the trigger level is lower than the crosstalk cancellation level, it can be determined that the second pad 13 is not actually struck but the vibration is caused by crosstalk of vibration of the first pad 12. Therefore, production of a sound corresponding to the vibration of the second pad 13 is not performed. For example, like the trigger level T2, when T indicating the trigger level of the second pad 13 is lower than the crosstalk cancellation level (y×R), it is determined that the vibration is caused by crosstalk of vibration of the first pad 12 and production of a sound based on the sound instruction information 62*a* corresponding to the vibration of the second pad 13 is not performed.

Here, the crosstalk cancellation level is obtained by multiplying the maximum vibration level in the vibration levels at the time x at which crosstalk cancellation determination is attempted in the crosstalk cancellation envelopes generated for pads other than the crosstalk cancellation determination target among a plurality of crosstalk cancellation envelopes stored in the crosstalk cancellation envelope area 32*a* by a crosstalk cancellation rate that is arbitrarily set for each pad as a determination target by the user. In the example in FIG. 4, regarding the crosstalk cancellation envelope, a crosstalk cancellation envelope is selected based on the vibration of the first pad 12 and the vibration level at the time x at which crosstalk cancellation determination is attempted is y. That is, the crosstalk cancellation level (CCL) can be obtained by the following Formula (3) using the vibration level (y) and the crosstalk cancellation rate (R). Here, the crosstalk cancellation rate is a coefficient used to determine, when a certain pad is struck and the vibration is transmitted to a pad that is a crosstalk cancellation determination target, a level of the vibration predicted to be received by the determination target pad.

$$CCL = y \times R \tag{3}$$

The description will return to FIG. 2, and description of the electrical configuration of the sound source device 11 will continue. The bus line 33 is a bundle of signal lines for exchanging information between the CPU 30, the ROM 31, the RAM 32, the first input circuit 34, the second input circuit 35, the A/D converter 37, the flash memory 38, the sound source circuit 39, the operator 41, and the display 42. The first input circuit 34 to the third input circuit 36 are interface circuits for connection to pads. The first pad 12 is connected to the first input circuit 34, the second pad 13 is connected to the second input circuit 35, and the third pad 14 is connected to the third input circuit 36.

The A/D converter 37 is a device for converting an analog signal to a digital signal. That is, the A/D converter 37 converts an analog signal (vibration level signal) transmitted from the third pad 14 to a digital signal every predetermined time.

The flash memory 38 is a rewritable non-volatile memory for storing information used in the computation of the CPU 30. In the flash memory 38, for example, third pad information 38*a*, a first pad crosstalk cancellation rate 38*b*, a second pad crosstalk cancellation rate 38*c*, and a third pad crosstalk cancellation rate 38*d* are stored. The third pad information 38*a* includes a crosstalk send gain and a normalization gain in the third pad 14. The third pad 14 does not have a CPU in the pad and generates sound emission data and crosstalk cancellation determination data like the first pad 12, and does not transmit them to the sound source device 11 as digital information. Therefore, even if the third pad 14 does not have a CPU, like the pad having a CPU, the third pad information 38*a* is stored in the flash memory 38 of the sound source device 11 so that the sound process and the crosstalk cancellation process can be performed. The third pad information 38*a* is used to perform the analog connection sound process to be described below with reference to FIG. 7 in the sound source device 11, and thus the same data as the sound emission data and crosstalk cancellation determination data shown in FIG. 3 can be generated. Here, the third pad information 38*a* is registered by the user by using the operator 41 while checking content displayed on the display 42 when the third pad 14 is initially connected to the sound source device 11.

The first pad crosstalk cancellation rate 38*b* is a crosstalk cancellation rate set for the first pad 12. In addition, the second pad crosstalk cancellation rate 38*c* is a crosstalk cancellation rate set for the second pad 13, and the third pad crosstalk cancellation rate 38*d* is a crosstalk cancellation rate set for the third pad 14.

The sound source circuit 39 is a circuit in which various types of sound source data are stored and which generates a tone and volume digital signal that the CPU 30 instructs the sound source circuit 39 to produce using the sound source data. For example, when the CPU 30 instructs the sound source circuit 39 to produce a sound based on the sound emission data 62*al* that is generated in the first pad 12 and transmitted to the sound source device 11, the sound source circuit 39 generates a tone and volume digital signal using the sound emission data 62*al*. The D/A converter 40 is a conversion device that converts the digital signal output from the sound source circuit 39 into an analog sound signal. The speaker 15 is a device that converts the sound signal transmitted from the D/A converter 40 into a physical vibration and produces a sound. That is, based on the sound instruction from the CPU 30, a tone and volume sound indicated by the sound instruction is produced from the speaker 15.

Figure 5:
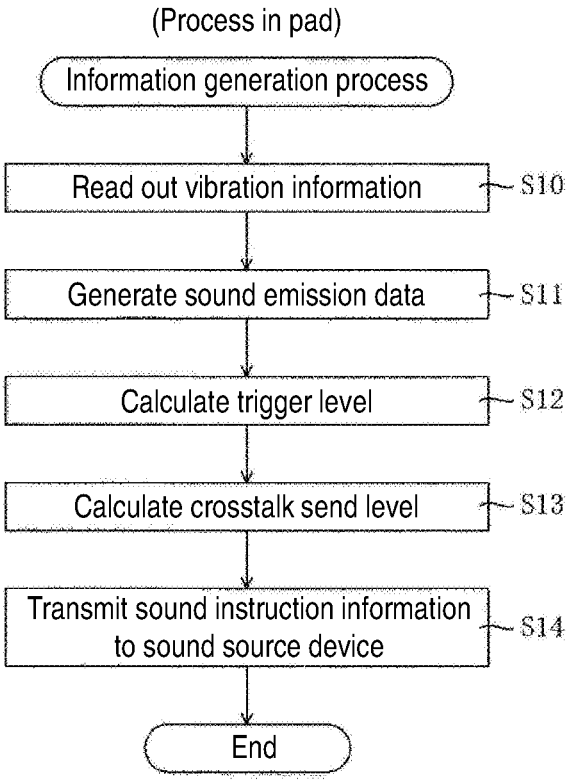
FIG. 5 is a flowchart of an information generation process performed in a first pad.

Subsequently, the information generation process executed in the CPU 60 in the first pad 12 will be described using the first pad 12 as an example with reference to FIG. 5. Here, also in the second pad 13, the same process is executed in the CPU provided in the second pad 13. FIG. 5 is a flowchart of the information generation process. The information generation process is a process for generating the sound instruction information 62*a* including the sound emission data 62*al* and the crosstalk cancellation determination data 62*a*2 transmitted from the first pad 12 to the sound source device 11. The information generation process is executed after the vibration sensor 64 of the first pad 12 detects a vibration.

In the information generation process, first, based on the vibration detected by the vibration sensor 64, vibration level information output to the CPU 60 is read out (S10).

Next, in the information generation process, the sound emission data 62*al* is generated (S11). That is, based on the vibration level information output from the vibration sensor 64, various types of information of the event type 202, the velocity MSB 203, the velocity LSB 204, and the radial position 205 within the sound instruction information 62*a* are generated. The event type 202 is generated according to determination of whether the strike is a head strike or a rim strike from the vibration level information. The velocity MSB 203 and the velocity LSB 204 are generated by determining the strength of the strike from the magnitude of the vibration level of the vibration level information. The most significant byte and the least significant byte of the generated velocity are stored as the velocity MSB 203 and the velocity LSB 204 in the sound emission data 62*al* in the RAM 62. The radial position 205 is generated by measuring a distance between the strike point and the center of the pad from the vibration level information. The generated information is stored in the sound instruction information 62*a* in the RAM 62.

Next, in the information generation process, the trigger level is calculated (S12). That is, the trigger level (TL) is obtained by the above Formula (1) using the sensor level (SL) and the normalization gain (NG).

The most significant byte and the least significant byte of the calculated trigger level are stored as the trigger level MSB 206 and the trigger level LSB 207 in the crosstalk cancellation determination data 62*a*2 in the RAM 62.

Next, in the information generation process, the crosstalk send level is calculated (S13). That is, the crosstalk send level (CSL) is obtained by the above Formula (2) using the sensor level (SL), the crosstalk send gain (CSG), and the normalization gain (NG).

The most significant byte and the least significant byte of the calculated crosstalk send level are stored as the crosstalk send level MSB 208 and the crosstalk send level LSB 209 in the crosstalk cancellation determination data 62*a*2 in the RAM 62.

Next, in the information generation process, the sound instruction information 62*a* including the sound emission data 62*al* and the crosstalk cancellation determination data 62*a*2 generated in the processes of S11 to S13 is generated, and transmitted to the sound source device 11 (S14). Thereby, it is not necessary to generate the sound emission data 62*al* and the crosstalk cancellation determination data 62*a*2 in the sound source device 11 and it is possible to reduce a load on the sound source device 11.

Next, the crosstalk cancellation process performed in the CPU 30 in the sound source device 11 will be described using information transmitted from the first pad 12 as an example with reference to FIG. 6. Here, the same process is executed in the CPU 30 provided in the sound source device 11 also based on information transmitted from the second pad 13 and the third pad 14. FIG. 6 is a flowchart of the crosstalk cancellation process. The crosstalk cancellation process is a process in which it is determined whether a vibration detected by one pad is caused by crosstalk from another pad, and when the vibration is caused by crosstalk, no sound is produced, and when the vibration is not caused by crosstalk, a sound is produced. The crosstalk cancellation process is a process that is performed with the reception of sound instruction information by the sound source device 11 as a trigger. Here, determination of crosstalk cancellation for the third pad 14 is performed with the acquisition of vibration level information of the third pad 14 by the sound source device 11 as a trigger.

In the crosstalk cancellation process, first, the crosstalk cancellation level of a comparison pad (here, the second pad 13 and the third pad 14) different from a target pad (here, the first pad 12) as a determination target in the crosstalk cancellation process is calculated (S30). The crosstalk cancellation level is obtained by multiplying the maximum vibration level in the vibration levels at the time x at which crosstalk cancellation determination is attempted in the crosstalk cancellation envelope of the comparison pad stored in the RAM 32 by a crosstalk cancellation rate that is arbitrarily defined for each pad by the user. That is, the crosstalk cancellation level (CCL) can be obtained by the above Formula (3) using the vibration level (y) and the crosstalk cancellation rate (R).

The calculated crosstalk cancellation level is stored in the RAM 32.

Next, in the crosstalk cancellation process, the trigger level MSB 206 and the trigger level LSB 207 included in the crosstalk cancellation determination data 62*a*2 of the target pad are combined into one piece of information, and based on the information, the trigger level of the pad as a determination target is read out (S31). Since the trigger level is 16-bit information, it is possible to obtain information with a high resolution.

Next, in the crosstalk cancellation process, the trigger level of the target pad read out in the process of S31 is compared with the crosstalk cancellation level of the comparison pad (S32). When the trigger level is equal to or higher than the crosstalk cancellation level, it is determined that the vibration of the target pad is not caused by crosstalk, and the CPU 30 instructs the sound source circuit 39 to provide a sound instruction (S33), and the process proceeds to the process of S34. On the other hand, when it is determined that the trigger level is not equal to or higher than the crosstalk cancellation level (No in S32), the vibration of the pad as a determination target is determined to be caused by crosstalk, the process of S33 is performed, that is, no sound is produced, and the process of S34 is performed.

In the process of S34, the crosstalk send level MSB 208 and the crosstalk send level LSB 209 included in the crosstalk cancellation determination data 62*a*2 transmitted from the target pad are read out (S34).

Next, in the crosstalk cancellation process, the crosstalk send level MSB 208 and the crosstalk send level LSB 209 read out in the process of S34 are combined into one piece of crosstalk send level information, and based on the information, the crosstalk cancellation envelope of the pad as a determination target is generated by the above method (S35).

Since the crosstalk send level is 16-bit information, it is possible to generate an envelope having a high resolution. The generated crosstalk cancellation envelope is stored in the RAM 32 and read out in the subsequent crosstalk process and used.

In the present embodiment, without generating the envelope in the first pad 12, the sound source device 11 generates an envelope corresponding to the first pad 12. This is because, as in the present embodiment, when analog connection pads are mixed, it is necessary to perform a process of generating an envelope in the sound source device 11, and it is not necessary to impart such a function to digital connection pads. In addition, it is not necessary to provide a high performance CPU in order to realize a function of generating an envelope in the first pad 12.

Figure 7:
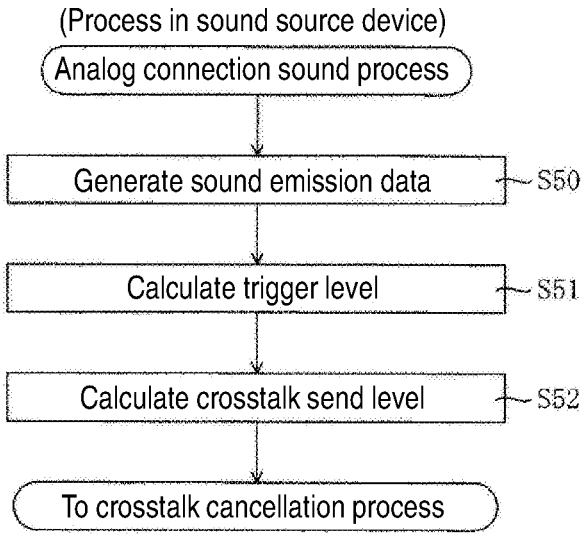
FIG. 7 is a flowchart of an analog connection sound process performed in a sound source device.

Subsequently, the analog connection sound process will be described using the third pad 14 as an example with reference to FIG. 7. FIG. 7 is a flowchart of the analog connection sound process performed in the CPU 30 in the sound source device 11. The analog connection sound process is a process in which sound emission data is generated for the vibration detected by the vibration sensor 67 of the third pad 14 connected to the sound source device 11 in an analog manner and the trigger level and the crosstalk send level are calculated.

In the analog connection sound process, sound emission data is generated (S50). That is, based on the vibration level information output from the third pad 14, an event type, a velocity MSB, a velocity LSB, and a radial position are generated. The generated information is stored in the RAM 32. Here, such a generation method is the same as in the process of S10 in the information generation process.

Next, in the analog connection sound process, the trigger level of the third pad 14 is calculated by the above Formula (1) (S51). That is, the trigger level (TL) is obtained using the sensor level (SL) and the normalization gain (NG).

The most significant byte and the least significant byte of the calculated trigger level are stored as the trigger level MSB and the trigger level LSB in the RAM 32.

Next, in the analog connection sound process, the crosstalk send level in the third pad 14 is calculated (S52). That is, the crosstalk send level (CSL) is obtained by the above Formula (2) using the sensor level (SL), the crosstalk send gain (CSG), and the normalization gain (NG).

The calculated crosstalk send level is stored as a crosstalk send level MSB and a crosstalk send level LSB in the RAM 32. After the process of S52, the crosstalk cancellation process shown in FIG. 6 is executed.

Therefore, in the analog connection type third pad 14, in the sound source device 11, crosstalk cancellation determination can be performed while generating sound emission data and crosstalk cancellation determination data. On the other hand, as in the first pad 12, even if the sound emission data 62*al* and the crosstalk cancellation determination data 62*a*2 are generated in the pad, crosstalk cancellation determination is performed by the sound source device 11. Therefore, even if a pad that is connected to the sound source device 11 in a digital manner like the first pad 12 and generates information for producing a sound in the pad and information for crosstalk and a pad that is connected to the sound source device 11 in an analog manner like the third pad 14 and generates such information in the sound source device 11 are connected to the sound source device 11, the crosstalk cancellation process can be performed for all of the pads.

As described above, according to the electronic drum system 10 in the present embodiment, in the first pad 12, the sound emission data 62*al* which is sound information and the crosstalk cancellation determination data 62*a*2 which is information for the crosstalk cancellation process are generated, and transmitted to the sound source device 11. The sound source device 11 executes crosstalk cancellation determination and the sound process using such information. Accordingly, since it is not necessary to generate the crosstalk cancellation determination data 62*a*2 in the sound source device 11, it is possible to reduce a load on the sound source device 11.

In addition, since the trigger level is read out from 16-bit information included in the crosstalk cancellation determination data 62*a*2, it is possible to obtain information with a high resolution. Similarly, since a crosstalk cancellation envelope is generated from the 16-bit information, it is possible to obtain an envelope with a high resolution. Since the crosstalk cancellation process is performed using these, it is possible to perform determination more accurately.

In addition, since the crosstalk send gain 61*a* and the normalization gain 61*b* representing characteristics of the first pad 12 are stored in the first pad 12, it is not necessary to store such information in advance in the sound source device 11. Thereby, the user does not need to register such information in the sound source device 11 and it is possible to reduce a burden on the user.

While the present invention has been described above based on the embodiment, the present invention is not limited to the above embodiment, and it can be easily understood that various modifications and improvements can be made without departing from the spirit and scope of the present invention. In addition, the numerical values shown in the above embodiment are examples, and other numerical values can be used naturally.

In the above embodiment, the sound source device 11, the first pad 12, and the second pad 13 are connected in a digital manner via a USB cable. However, the present invention is not limited to USB communication. For example, controller area network (CAN) communication or wireless communication may be used.

In the above embodiment, the number of pads connected to the sound source device 11 is 3. However, the present invention is not limited thereto, and an arbitrary number of pads can be used. In addition, in the above embodiment, among three pads, two pads are of a digital connection type, and one pad is of an analog connection type. However, the ratio between the number of digital connection type pads and the number of analog connection type pads is not limited thereto.

In the above embodiment, the analog connection type third pad 14 has been exemplified as an example of a pad that cannot generate sound emission data and crosstalk cancellation determination data in the pad. However, the present invention is not limited thereto. For example, a digital connection type pad that cannot generate sound emission data and crosstalk cancellation determination data in the pad may be used. However, in this case, since the crosstalk cancellation process is executed using sound information, the accuracy of the crosstalk cancellation process may be lowered.

In the above embodiment, one packet is transmitted as 16-byte data from the first pad 12 to the sound source device 11. However, the size of the packet is not limited to 16 bytes. In addition, in the present embodiment, the packet is used. However, the present invention is not limited thereto. For example, parallel communication or the like can be used.

In the above embodiment, a plurality of pads are provided on the same stand S. However, the present invention is not limited thereto. For example, an electronic percussion instrument in which a plurality of pads are provided in the same housing may be used.

In the above embodiment, the vibration level of the comparison struck surface during determination of the crosstalk cancellation process is obtained from the crosstalk cancellation envelope, and the crosstalk cancellation level on the target struck surface is calculated from the vibration level. However, determination of crosstalk is not limited to such a method. For example, a vibration on the target struck surface is detected within a predetermined time after a vibration on the comparison struck surface is generated, and when the trigger level on the target struck surface is lower than a level value obtained by multiplying the crosstalk send level (peak value) on the comparison struck surface by a crosstalk cancellation rate, it may be determined that there is crosstalk.

In the above embodiment, the pad that outputs digital signal sound instruction information is used as a strike detection device. However, the present invention is not limited thereto. For example, a Trigger to USB converter (hereinafter referred to as a Trigger converter) that can convert an analog signal into a USB signal and output the result is connected between the analog connection type pad and the sound source device 11 as a strike detection device, and the sound instruction information generated by the Trigger converter may be transmitted to the sound source device 11. That is, based on the vibration level information output from the analog connection type pad, sound emission data and crosstalk cancellation determination data as sound instruction information may be generated in the Trigger converter, and transmitted to the sound source device 11. Specifically, event type, velocity MSB, velocity LSB, and radial position information are generated as sound emission data, and trigger level MSB, trigger level LSB, crosstalk send level MSB, and crosstalk send level LSB information are generated as crosstalk cancellation determination data, and the generated information may be transmitted to a sound source device as, for example, one packet. Here, a configuration in which a plurality of analog connection type pads can be connected to one Trigger converter may be used.

In the above embodiment, vibration level information is transmitted from the analog connection type third pad 14 to the sound source device 11, and thus sound emission data and crosstalk cancellation determination data is generated in the CPU 30 of the sound source device 11. Then, based on the crosstalk cancellation determination data, the crosstalk cancellation envelope is generated in the CPU 30. However, the present invention is not limited thereto. For example, a rectifier circuit and a smoothing circuit are provided in the third input circuit 36 of the sound source device 11, and thus a crosstalk cancellation envelope may be created in the third input circuit 36. That is, vibration level information of waveforms transmitted from the third pad 14 is rectified by a rectifier circuit to obtain a rectified signal. A smooth signal obtained by smoothing the rectified signal in a smoothing circuit may be used as a crosstalk cancellation envelope. Thereby, since it is not necessary to generate a crosstalk cancellation envelope of the third pad 14 in the CPU 30, it is possible to reduce a load on the CPU 30.

The invention claimed is:

1. A sounding control system, comprising:

a plurality of struck surfaces configured to be struck by a user;

at least one strike detection device that generates a sound instruction information based on a vibration that is generated by striking the struck surfaces; and a sounding control device configured to be connectable to the strike detection device and control, based on the sound instruction information generated by the strike detection device, a musical sound production corresponding to the generated sound instruction information, wherein the strike detection device includes a first processor, and the first processor is configured to function as:

generating the sound instruction information for instructing the sounding control device to produce a sound based on a vibration on the struck surface, generating a strike strength information indicating a strike strength of the struck surface based on a vibration on the struck surface, generating a vibration strength information indicating a vibration strength of the struck surface when the struck surface is struck based on a vibration on the struck surface, and transmitting the generated sound instruction information to the sounding control device, and transmitting the generated strike strength information and the generated vibration strength information to the sounding control device together with a transmission of the sound instruction information, wherein the sounding control device includes a second processor, and the second processor is configured to function as:

determining, based on a reception of the transmitted sound instruction information, whether a vibration generated on a target struck surface which is a struck surface corresponding to the transmitted sound instruction information is caused by a crosstalk that should not be produced, which is generated based on a vibration on a comparison struck surface which is a struck surface other than the target struck surface, when it is determined that a vibration generated on the target struck surface is not caused by the crosstalk that should not be produced, executing a production of a sound for the vibration, and on the other hand, when it is determined that a vibration generated on the target struck surface is caused by the crosstalk that should not be produced, not executing a production of a sound for the vibration, and generating a vibration status information which is an information that simulates a vibration status of a struck surface corresponding to the vibration strength information based on the transmitted vibration strength information, and wherein a degree of the crosstalk received from the comparison struck surface is calculated based on the generated vibration status information for the comparison struck surface, and whether a vibration generated on the target struck surface is caused by the crosstalk that should not be produced is determined based on a comparison between the degree of the crosstalk calculated and the strike strength information transmitted together with the sound instruction information.

2. The sounding control system according to claim 1, wherein the sounding control system includes a second strike detection device configured to output a vibration strength of the struck surface based on a vibration generated by striking the struck surface, wherein the sounding control device configured to be connectable to the second strike detection device, wherein the second processor of the sounding control device is further configured to function as:

generating a strike strength information indicating a strike strength of the struck surface based on the vibration strength of the struck surface output from the second strike detection device, and generating a vibration strength information indicating a vibration strength of the struck surface when the struck surface is struck based on the vibration strength of the struck surface output from the second strike detection device, wherein a vibration status information which is an information that simulates the vibration status of the struck surface corresponding to the vibration strength information output from the second strike detection device is generated based on the vibration strength information generated, and wherein, when a vibration on a corresponding struck surface is detected based on the output from the second strike detection device, the struck surface on which the vibration is detected is set as a target struck surface and a struck surface other than the target struck surface is set as a comparison struck surface, whether a vibration generated on the target struck surface is caused by a crosstalk that should not be produced based on comparison between the degree of the crosstalk calculated and the strike strength information generated is determined.

3. The sounding control system according to claim 1, wherein a detection element configured to detect a vibration strength caused by striking a corresponding struck surface is provided in each of the plurality of struck surfaces, wherein the strike detection device includes a first adjustment factor storage means for storing a first adjustment factor set for each of the detection elements in order to adjust a difference in absolute values of an output of the vibration strength due to a structure of one struck surface on which one detection element is provided and another struck surface on which another detection element is provided, and wherein the vibration strength is multiplied by the first adjustment factor corresponding to the detection element that has detected the vibration strength stored in the first adjustment factor storage means and the strike strength information indicating the strike strength of the struck surface is generated.

4. The sounding control system according to claim 1, wherein a detection element configured to detect a vibration strength caused by striking a corresponding struck surface is provided in each of the plurality of struck surfaces, wherein the strike detection device includes a second adjustment factor storage means for storing a first adjustment factor set for each of the detection elements in order to adjust a difference in absolute values of an output of the vibration strength due to a structure of one struck surface on which one detection element is provided and another struck surface on which another detection element is provided and a second adjustment factor set for each of the struck surfaces indicating an ease of transmission of the vibration to the sounding control system on the struck surface, and wherein the first adjustment factor corresponding to the detection element that has detected the vibration strength stored in the second adjustment factor storage means for the vibration strength is multiplied by the second adjustment factor corresponding to the struck surface that is struck and the vibration strength information indicating the vibration strength in the strike detection device when the struck surface is struck is generated.

5. The sounding control system according to claim 1, wherein each of the plurality of struck surfaces is provided in the strike detection device, and the strike detection device detects a strike on the struck surfaces.

6. The sounding control system according to claim 1, wherein the generated vibration status information is a virtual envelope that simulates the vibration status of the struck surface corresponding to the transmitted vibration strength information.

7. The sounding control system according to claim 1, wherein the strike detection device and the sounding control device are capable to be connected via a Universal Serial Bus (USB).

8. The sounding control system according to claim 1, wherein the generated strike strength information and the generated vibration strength information are capable to be transmitted to the sounding control device together with the transmission of the sound instruction information through a packet communication.

9. The sounding control system according to claim 1, wherein the plurality of struck surfaces are held by one supporting body.

10. The sounding control system according to claim 2, wherein a detection element configured to detect a vibration strength caused by striking on a corresponding struck surface is provided in each of the plurality of struck surfaces, wherein the strike detection device includes a first adjustment factor storage means for storing a first adjustment factor set for each of the detection elements in order to adjust a difference in absolute values of an output of the vibration strength due to a structure of one struck surface on which one detection element is provided and another struck surface on which another detection element is provided, and wherein the vibration strength is multiplied by the first adjustment factor corresponding to the detection element that has detected the vibration strength stored in the first adjustment factor storage means and the strike strength information indicating the strike strength of the struck surface is generated.

11. The sounding control system according to claim 2, wherein a detection element configured to detect a vibration strength caused by striking a corresponding struck surface is provided in each of the plurality of struck surfaces, wherein the strike detection device includes a second adjustment factor storage means for storing a first adjustment factor set for each of the detection elements in order to adjust a difference in absolute values of an output of the vibration strength due to a structure of one struck surface on which one detection element is provided and another struck surface on which another detection element is provided and a second adjustment factor set for each of the struck surfaces indicating an ease of transmission of the vibration to the sounding control system on the struck surface, and wherein the first adjustment factor corresponding to the detection element that has detected the vibration strength stored in the second adjustment factor storage means for the vibration strength is multiplied by the second adjustment factor corresponding to the struck surface that is struck and the vibration strength information indicating the vibration strength in the strike detection device when the struck surface is struck is generated.

12. The sounding control system according to claim 2, wherein each of the plurality of struck surfaces is provided in the strike detection device, and the strike detection device detects a strike on the struck surface.

13. The sounding control system according to claim 2, wherein the generated vibration status information is a virtual envelope that simulates the vibration status of the struck surface corresponding to the transmitted vibration strength information.

14. The sounding control system according to claim 2, wherein the strike detection device and the sounding control device are able to be connected via a Universal Serial Bus (USB).

15. The sounding control system according to claim 2, wherein the generated strike strength information and the generated vibration strength information is able to be transmitted to the sounding control device together with the transmission of the sound instruction information through packet communication.

16. The sounding control system according to claim 2, wherein the plurality of struck surfaces are held by one supporting body.

17. The sounding control system according to claim 2, wherein a strength of the struck surface output from the second strike detection device is an analog type information.

18. A sounding control method, adapted to control a sounding control device, comprising:

a step of providing a plurality of struck surfaces configured to be struck by a user;

a step of at least one strike detecting that generates a sound instruction information based on a vibration that is generated by striking the struck surfaces; and wherein the sounding control device includes a first processor and the first processor is configured to function as performing:

a step of sounding control that controls, based on the sound instruction information generated in the step of strike detecting, a musical sound production corresponding to the generated sound instruction information, wherein the step of strike detecting includes a step of sound instruction information generating that generates the sound instruction information for instructing the sounding control device to produce a sound based on a vibration on the struck surface, a step of strike strength information generating that generates a strike strength information indicating a strike strength of the struck surface based on a vibration on the struck surface, a step of vibration strength information generating that generates a vibration strength information indicating a vibration strength of the struck surface when the struck surface is struck based on a vibration on the struck surface, and a step of transmitting that transmits the sound instruction information generated in the step of sound instruction information generating to the sounding control device, and transmits the strike strength information generated in the step of strike strength information generating and the vibration strength information generated in the step of vibration strength information generating to the sounding control device together with a transmission of the sound instruction information, wherein the sounding control device includes a second processer and the second processor is configured to function as performing the following steps of the sounding control method:

a step of determining that determines, based on a reception of the sound instruction information transmitted in the step of transmitting, whether a vibration generated on a target struck surface which is a struck surface corresponding to the transmitted sound instruction information is caused by a crosstalk that should not be produced, which is generated based on a vibration on a comparison struck surface which is a struck surface other than the target struck surface, when it is determined in the step of determining that a vibration generated on the target struck surface is not caused by the crosstalk that should not be produced, a production of a sound for the vibration is executed, and on the other hand, when it is determined that a vibration generated on the target struck surface is caused by the crosstalk that should not be produced, a production of a sound for the vibration is not executed, and a step of vibration status information generating that generates a vibration status information which is an information that simulates a vibration status of a struck surface corresponding to the vibration strength information based on the vibration strength information transmitted in the step of transmitting, and wherein the step of determining that calculates a degree of the crosstalk received from the comparison struck surface based on the vibration status information generated in the step of vibration status information generating for the comparison struck surface, and determines whether a vibration generated on the target struck surface is caused by the crosstalk that should not be produced based on a comparison between the degree of the calculated crosstalk and the strike strength information transmitted in the step of transmitting together with the sound instruction information.

19. The sounding control method according to claim 18, wherein the sounding control method includes a step of second strike detecting that outputs a vibration strength of the struck surface based on a vibration generated by striking the struck surface, wherein the sounding control method includes a step of second strike strength information generating that generates a strike strength information indicating a strike strength of the struck surface based on the vibration strength of the struck surface output in the step of second strike detecting, and a step of second vibration strength information generating that generates a vibration strength information indicating a vibration strength of the struck surface when the struck surface is struck based on the vibration strength of the struck surface output in the step of second strike detecting, wherein the step of vibration status information generating generates a vibration status information which is an information that simulates the vibration status of the struck surface corresponding to the vibration strength information output in the step of second strike detecting based on the vibration strength information generated in the step of second vibration strength generating, and wherein, when a vibration on a corresponding struck surface is detected based on the output in the step of second strike detecting, the struck surface on which the vibration is detected is set as a target struck surface and a struck surface other than the target struck surface is set as a comparison struck surface, the step of determining determines whether a vibration generated on the target struck surface is caused by a crosstalk that should not be produced based on comparison between the degree of the calculated crosstalk and the strike strength information generated in the step of second strike strength information generating.

20. The sounding control method according to claim 19, wherein a strength of the struck surface output in the step of second strike detecting is an analog type information.

* * * * *